United States Patent [19]

Muth

[11] 4,211,133

[45] Jul. 8, 1980

[54] SLICER OUTLET EXTENDER

[76] Inventor: William J. Muth, 6342 Charles St., Omaha, Nebr. 68132

[21] Appl. No.: 12,324

[22] Filed: Feb. 15, 1979

[51] Int. Cl.[2] ..... B26D 7/06

[52] U.S. Cl. ..... 83/162; 83/165; 83/701; 241/100

[58] Field of Search ..... 83/165, 164, 162, 859, 83/701; 241/100

[56] References Cited

U.S. PATENT DOCUMENTS

| | | | |
|---|---|---|---|
| 625,215 | 5/1899 | Tice | 83/165 X |
| 2,024,715 | 12/1935 | Bennett | 83/165 X |
| 3,757,622 | 9/1973 | Berry | 83/165 |
| 3,907,214 | 9/1975 | Dankel | 241/100 X |

*Primary Examiner*—Frank T. Yost

[57] ABSTRACT

The slicer outlet extender for attachment to the outlet housing of a slicing machine, such housings opening downwardly and being larger at the lower ends, the extender comprising an elongated piece of material which wraps around the outside of the lower end of the outlet, and overlaps itself, and connecting means interconnecting the lapping ends of the extender, such as pieces on each end of the extender having inter-engaging hook portions.

6 Claims, 5 Drawing Figures

SLICER OUTLET EXTENDER

BACKGROUND OF THE INVENTION

This invention is in the field of slicers for meat and other foods, such slicers having downwardly opening outlet housings tapered around their outer sides so as to be larger at their lower ends.

Heretofore it has been a problem that small portions of cheese, cabbage, green peppers, carrots, other vegetables and meat tend to fall out of the outlet sufficiently haphazardly that they tend to fall on the floor, causing waste.

Most restaurants do not have a container on hand which is sufficiently large to catch the materials from the outlet in order to prevent this waste.

A container of considerable size would be needed because a container which is quite small and held up very close in order to compensate for its smallness would be so close that it would be necessary for an operator to be reaching into the food continually to redistribute the position of the food so that it does not concentrate in one place and clog up the outlet that this would be an unsanitary amount of food handling.

In my experience with various restaurants, as a practical matter, excessive food is wasted through falling on the floor.

It is, therefore, an object of this invention to provide an extension for the outlet which can be easily and quickly put in place around the outlet and which can be either removed for cleaning, or, more practically, removed for replacement, since it can be made of relatively inexpensive material.

It would be possible, of course, for the manufactures to make the outlet housings longer, but they do not do so, probably because of cost. So the problem is a very real one.

The problem is acute because food prices are high and there are hundreds of thousands of these slicers on the market, creating very unsanitary conditions because of the mass they make on the floor.

SUMMARY OF THE INVENTION

The main goal of this invention is to provide a slicer outlet extender for attachment to the outlet housing of a slicing machine, such housings opening downwardly and being larger at the lower ends, the extender comprising an elongated piece of material which wraps around the outside of the lower end of the outlet, and overlaps itself, and connecting means interconnecting the lapping ends of the extender, such as pieces on each end of the extender having inter-engaging hook portions.

DESCRIPTION OF THE PREFERRED EMBODIMENT

Figure 1:
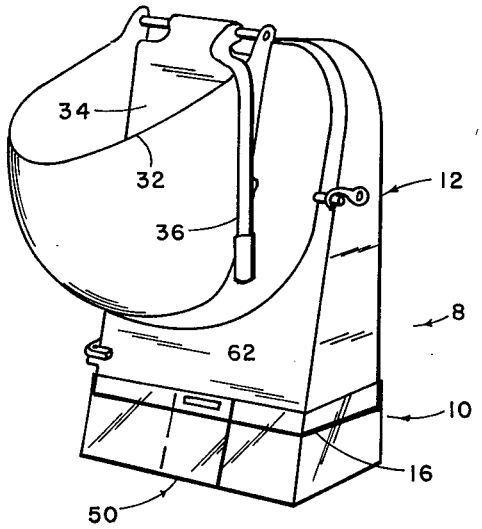
FIG. 1 is a perspective view of a slicer with the extender of this invention thereon, as seen from the front and partly to the right side thereof.

The slicer outlet extender of this invention is generally shown at 10 in FIG. 1 as attached to a slicing machine, generally indicated at 12, having an outlet 14, which latter has an open lower end 16, from which sliced meat falls. Slicers of the kind shown have an inlet 32 and a hingedly mounted pusher plate 34 for pushing meat disposed through the inlet into slicing elements of the slicer which are not shown, such pushing being accomplished by means of manipulation of a lever 36.

Figure 2:
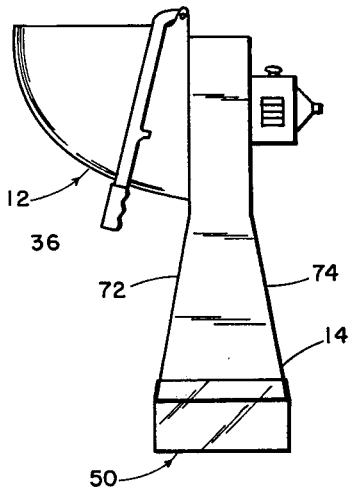
FIG. 2 is a view of the slicer of FIG. 1 as it would be seen in a left side elevation with the extender attached.

The outlet 14 of most slicers is of a tapered shape, as best seen in FIG. 2, so that the lowermost end of the outlet 14 is of a larger horizontal cross-sectional size around its outer perimeter than portions of the outlet 14 which are disposed above the lowermost end.

In accordance with this invention, an extender generally indicated at 50, is provided and can be of an oblong rectangular shape, having long upper and lower edges 52 and 54, such as about 31 inches, for example. An extender 50 might have a vertical dimension along its end edges 56 and 58 of about 9 inches.

The extender 50 is formed of flexible material and probably of thermo-plastic material, such as vinyl is desirable.

The extender 50 can be transparent, if desired.

A small piece of material of a kind known on the market as Velcro can be placed at 60 at the top of the extender, adjacent one end thereof, and on one side thereof. Another piece of Velcro 62 can be placed on the upper side of the extender and on an opposite side of the extender from the piece 60, so that the pieces 60 and 62 can be pressed together and interlocked in order to hold the extender in an annular shape conforming by close fitting to the lower end of the outlet 14 of the slicer.

The Velcro pieces 60 and 62 are formed of a material having projecting hooks of a very small size, so that the hooks on one piece of Velcro 60 interlock with the hooks on the other piece of Velcro 62 so that they are firmly held together whenever they are interlocked, and yet the two pieces of Velcro 60 and 62 can be pulled apart for the removal of the extender 50 when desired.

An extender 50 can be washed and reused or it can be disposed of. In the latter case a user would buy a quantity of extenders 50 at one time.

As best seen in FIG. 1, the placing of the two Velcro pieces 60 and 62 against each other will cause an overlap in the ends of the extender, as shown.

Because the lower end of the outlet 14 tapers outwardly on forward and rearward sides 72 and 74 of the slicer so as to be larger at the lower end of the outlet 14, and, therefore, the extender will hold firmly in place.

Figure 3:
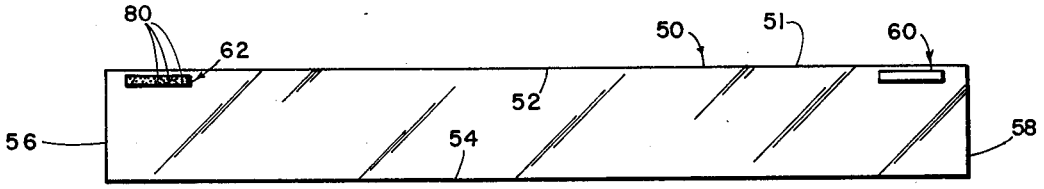
FIG. 3 is a detail showing the extender of this invention in a flat form before it is applied to the machine.
Figure 4:
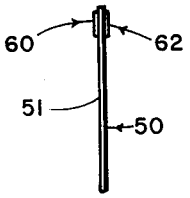
FIG. 4 is a view showing the extender of FIG. 3, as it would be seen from the left end thereof.
Figure 5:
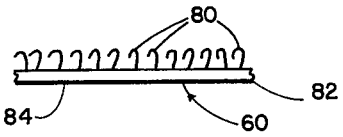
FIG. 5 is a detail showing a piece of material of a kind having small hooks on it which is affixed to the body of the extender for cooperation with a similar piece of material to attach end portions of the extender together.

In FIG. 5, it will be seen that a piece of Velcro 60 has a plurality of projecting hooks 80 on one side, which are formed of flexible pieces of thermoplastic material, and they are in great number and are spaced over a substantial area, as best seen in FIG. 3, with the result that when the hooks 80 of one piece of Velcro 62 are pressed against the hooks 80 of another piece of Velcro 60, then the hooks interlock, causing an easily releasable connection.

The hooks 80 of a piece of Velcro 60 are mounted on a base 82 and in the use of the Velcro piece 80 a piece of pressure sensitive adhesive material 84 is provided on the opposite side of the base 82 from the hooks 80, the piece 84 being connected to the base 82 by suitable bonding means.

The pressure sensitive piece of material 84 is itself used to bond the base 82 to the body 51 of the extender 50.

A slicer outlet extender and slicing assembly 8 is formed by the slicer 12 and the extender 50, which latter is preferably transparent in its body portion 51, the body portion usually being of approximately twelve inches in vertical height for the majority of slicers on the market today and the extended length of the body portion 51 is about thirty one inches.

I claim:

1. A slicer outlet extender and slicing assembly comprising a slicing machine having an outlet housing provided with an outer side which is larger in a lower portion than above said lower portion as seen in a horizontal plane, and an outlet extender, said extender having a body portion which is an elongated piece of material wrapped horizontally around the outside of the lower end of said outlet housing and said body portion having end portions which lap each other as seen in top plan view, and connecting means comprising two elements respectively disposed on and secured to the respective lapping ends of said body portion, said two elements being secured together for interconnecting said lapping ends of said body portion.

2. The slicer outlet extender of claim 1 comprising said elements having inter-engaging projecting hook portions.

3. The slicer outlet extender of claim 2 comprising said elements being secured to said body portion by pressure sensitive adhesive.

4. The slicer outlet extender of claim 1 in which said body portion is substantially all formed of a flexible material.

5. The slicer outlet extender of claim 1 in which said body portion is formed of a flexible thermoplastic material.

6. The slicer outlet extender of claim 1 comprising said elements having inter-engaging projecting hook portions, said elements being secured to said body portion by pressure sensitive adhesive, said body portion is substantially all formed of a flexible material, said body portion being formed of a flexible thermoplastic material.

* * * * *